US005996875A

United States Patent [19]

Clark et al.

[11] Patent Number: 5,996,875

[45] Date of Patent: Dec. 7, 1999

[54] POWER ACTUATED FASTENING TOOL

[75] Inventors: Philip Charles Clark, Vermont South; Brian Diener, Christies Beach; Brian Douglas Renshaw, Morphett Vale, all of Australia

[73] Assignee: Ramset Fasteners (Aust.) Pty, Limited, Australia

[21] Appl. No.: 08/836,492

[22] PCT Filed: Nov. 15, 1995

[86] PCT No.: PCT/AU95/00754

§ 371 Date: Nov. 3, 1997

§ 102(e) Date: Nov. 3, 1997

[87] PCT Pub. No.: WO96/15880

PCT Pub. Date: May 30, 1996

[30] Foreign Application Priority Data

Nov. 17, 1994 [AU] Australia ..... PM 9488

[51] Int. Cl.[6] ..... B25C 1/04

[52] U.S. Cl. ..... 227/10; 227/9

[58] Field of Search ..... 227/9, 10, 11

[56] References Cited

U.S. PATENT DOCUMENTS

| | | | |
|---|---|---|---|
| 3,688,964 | 9/1972 | DeCaro | 227/10 |
| 3,973,605 | 8/1976 | DeCaro | 227/10 |
| 4,295,394 | 10/1981 | DeCaro | 81/57.37 |
| 4,358,041 | 11/1982 | Ollivier | 227/10 |
| 4,655,380 | 4/1987 | Haytayan | 227/9 |
| 4,705,200 | 11/1987 | Kopf | 227/9 |
| 4,741,467 | 5/1988 | Gassner et al. | 227/10 |
| 4,804,127 | 2/1989 | Kirkman | 227/10 |
| 4,809,568 | 3/1989 | DeCaro | 81/435 |
| 4,867,365 | 9/1989 | Beuchel et al. | 227/10 |
| 5,657,919 | 8/1997 | Berry | 227/10 |
| 5,797,534 | 8/1998 | Almeras et al. | 227/10 |

FOREIGN PATENT DOCUMENTS

| | | |
|---|---|---|
| 15290/76 | 1/1978 | Australia . |
| 50205/90 | 8/1990 | Australia . |

*Primary Examiner*—Peter Vo
*Assistant Examiner*—James P. Calve
*Attorney, Agent, or Firm*—Harness, Dickey & Pierce, P.L.C

[57] ABSTRACT

The barrel of a power actuated tool for driving a fastener into a substrate upon detonation of an explosive charge, comprises front (4) and rear (2) barrel sections mounted for telescopic movement to absorb recoil upon firing. The sections are held in assembled relation by a retainer element (14) and are such that assembly and disassembly can occur by manipulation of one barrel section relative to other without the need to remove the retainer element (14).

2 Claims, 3 Drawing Sheets

POWER ACTUATED FASTENING TOOL

BACKGROUND OF THE INVENTION

The present invention relates to a power actuated fastening tool for driving a fastener, such as a nail, into a substrate, such as a concrete or steel structure.

Power actuated tools for driving a fastener into a substrate conventionally comprise a barrel from which the fastener is expelled by means of a piston driven by detonation of an explosive charge. The barrel is mounted for axial movement within a receiver assembly or body of the tool and after firing can be moved forwardly of the receiver assembly in order to reset the piston into the rear end of the barrel, the barrel with the piston then being retracted back into the body assembly in preparation for the next detonation. For this purpose the barrel normally has an axial slot into which can extend a pawl which engages and restrains the piston when the barrel is moved forwardly so that the piston is reset in the rear end of the barrel during this movement.

In one previously proposed tool of this type as disclosed in International patent application PCT/AU90/00019 the barrel comprises separate front and rear sections, the rear section being telescopically mounted within the front section to permit limited axial movement between the two sections. The construction of the barrel in two separate sections facilitates manufacture of the barrel and the provision for limited axial movement between the front and rear sections enables recoil on firing of the tool to be absorbed by relative axial movement between the two sections to an extended configuration. In this previously proposed tool the two sections of the barrel are held in assembled relationship by retaining segments held by means of a spring clip. In a tool of this type, it is necessary to periodically disassemble the barrel for cleaning purposes, which requires removal of the clip and segments. The disassembly and subsequent reassembly requires a degree of dexterity which is not always possible within the environment of a construction site, and sometimes the segments are dropped and become lost.

SUMMARY OF THE INVENTION

According to the present invention, there is provided a power actuated tool comprising a barrel having a piston for driving a fastener into a substrate upon firing of an explosive charge, the barrel being mounted for axial movement within a body of the tool whereby to permit resetting of the piston to the rear of the barrel after firing by withdrawing the barrel forwardly of the body, wherein the barrel comprises front and rear sections mounted for telescopic movement one relative to the other to an extent sufficient to absorb recoil on firing of the tool, and at least one retainer element interposed between the front and rear barrel sections to cause entrainment of the rear barrel section with the front barrel section when the latter is drawn forwardly of the body in order to reset the piston, the configuration being such that assembly and disassembly of the barrel sections can be accomplished by relative movement between the barrel sections without the need to remove the retainer element.

In a preferred embodiment of the invention the retainer element is carried by the front barrel section and engages a rearwardly facing abutment surface of the rear barrel section to cause entrainment of the rear barrel section when the front barrel section is drawn forwardly, the abutment surface of the rear barrel section being at the forward end of an axial track which receives the retainer element whereby movement of the barrel sections between contracted and extended positions is guided by cooperation between the retainer element and track. The retainer element is engageable into the axial guidance track on assembly of the barrel sections by movement through at least one transverse transfer track opening into the axial guidance track.

Preferably, the guidance and transfer tracks are each defined by a slot or groove formed in the rear barrel section.

Preferably, the transfer track communicates at its end remote from the guidance track with a further axial track which opens onto the forward end edge of the rear barrel section whereby assembly of the two barrel sections occurs by movement of the retainer element along the latter axial track from the forward end thereof until the transfer track is reached, such movement occurring as a result of relative axial movement between the two barrel sections and then a rotational movement between the two barrel sections to feed the retainer element through the transfer track and into the main guidance track. The track through which the retainer element is inserted may be defined by an axial slot formed in the rear barrel section for receiving a pawl for resetting the piston when the barrel is drawn forwardly relative to the body.

Preferably, there are two such retainer elements and associated guidance tracks in approximate diametrically-opposed relation. However it is preferred that the two retainer elements are not in exact diametrically-opposed relation to ensure that the front and rear barrel sections can be assembled in only one relative angular orientation.

Preferably, the or each retainer element is formed by a shear pin which is adapted to shear as a consequence of high energy impact against the rearwardly facing abutment surface as may occur in an overload situation.

According to another aspect of the present invention, there is provided a barrel for a power actuated tool for driving a fastener into a substrate upon detonation of an explosive charge, said barrel comprising front and rear barrel sections mounted for telescopic movement to absorb recoil upon firing, the sections being held in assembled relation by a retainer element and being such that assembly and disassembly can occur by manipulation of one barrel section relative to the other without the need to remove the retainer element.

BRIEF DESCRIPTION OF THE DRAWINGS

An embodiment of the invention will now be described, by way of example only, with reference to the accompanying drawings, in which.

DESCRIPTION OF THE PREFERRED EMBODIMENT

Figure 1:
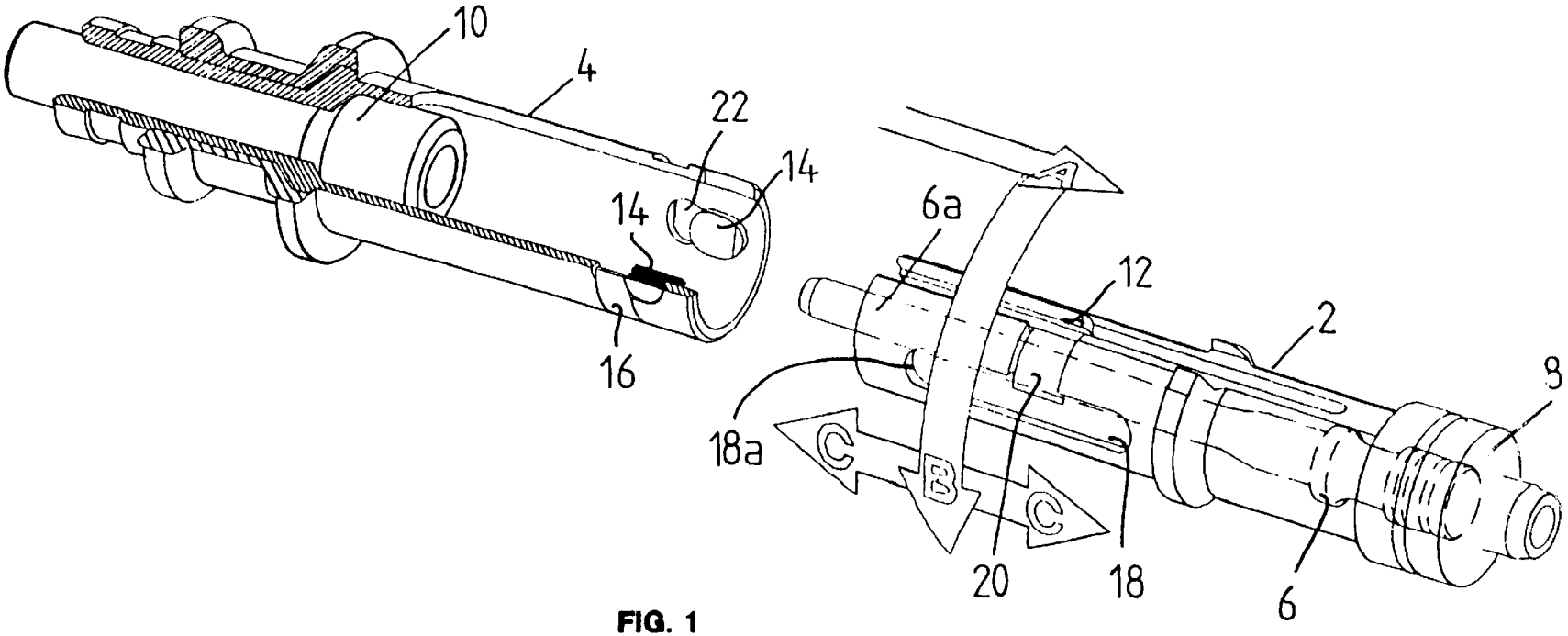
FIG. 1 is a schematic view, partially in section, showing front and rear barrel sections of a tool in disassembled relation.
Figure 2:
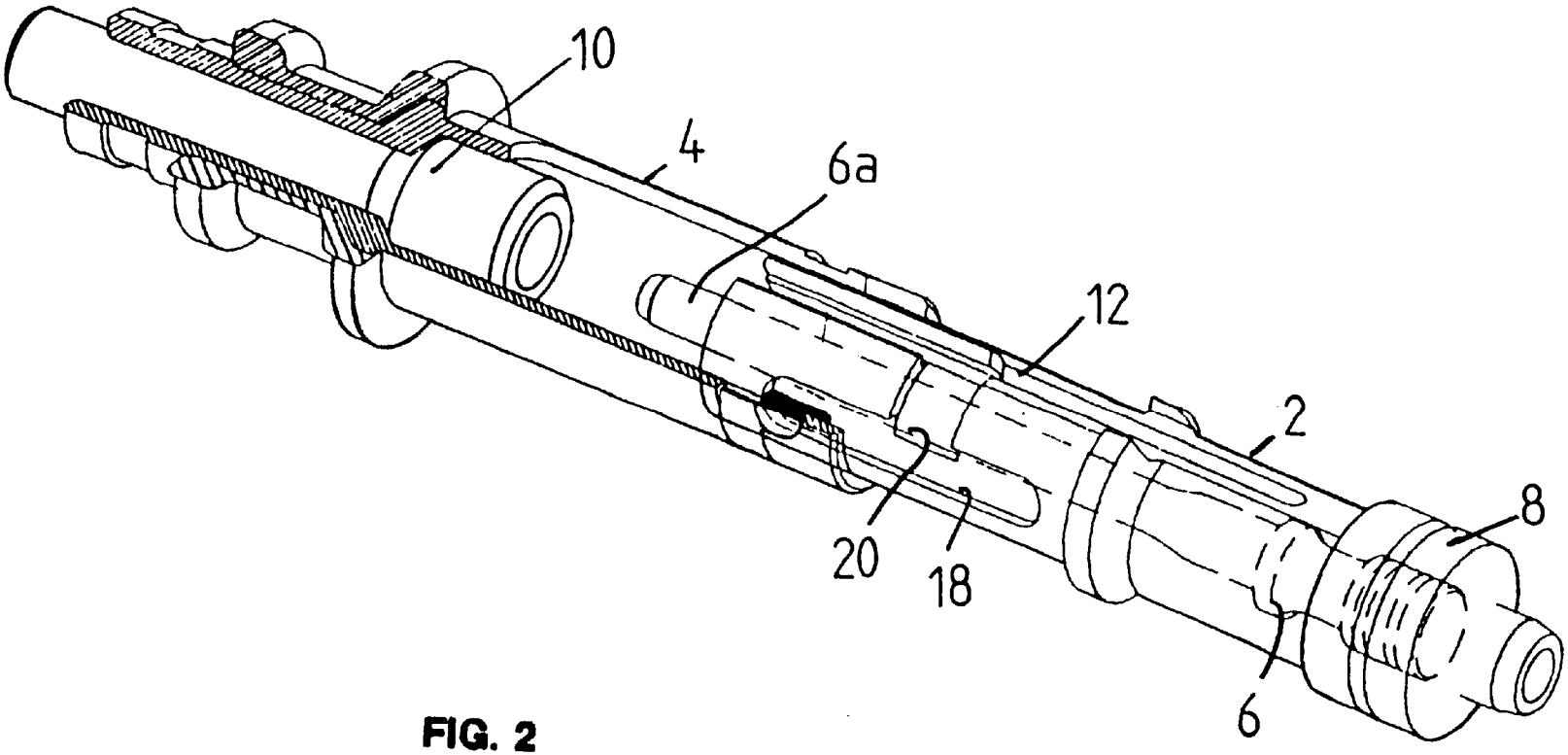
FIG. 2 shows the two barrel sections in assembled relation.
Figure 3:
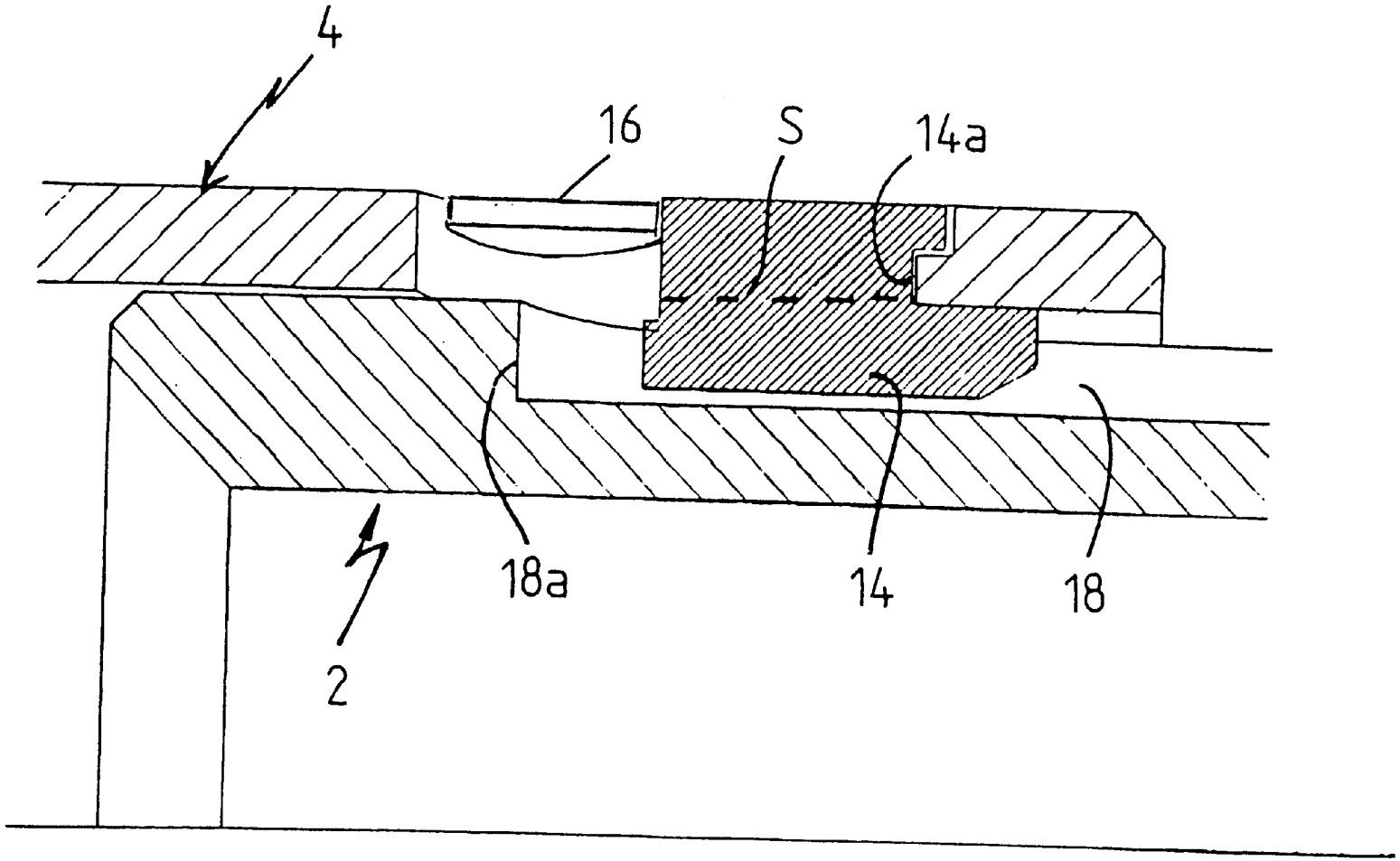
FIG. 3 is an enlarged section showing a retainer element between the barrel sections.

As shown in the drawings a barrel of a power actuated tool in accordance with the invention comprises rear and front barrel sections 2,4 which house a piston 6, the forward portion 6*a* of which forms a driving pin for driving the fastener. A charge chamber 8 formed at a rear end of the barrel acts to receive an explosive charge which, on detonation, propels the piston 6 forwardly within the barrel in order to discharge into a work surface a fastener held within a guide 10 at the front end of the barrel. The front barrel section 4 is mounted telescopically over the rear section 2 and the sections 2,4 are movable between an axially contracted condition on firing the tool and an axially extended condition as shown in FIG. 2 in which the front barrel section 4 entrains the rear section 2 to enable both sections to be drawn forwardly from the receiver assembly or body (not shown) of the tool in order to reset the piston 6 into the rear end of the barrel. Resetting of the piston 6 occurs by engagement of the piston 6 with a pawl (not shown) carried by the tool body and which projects through an axial slot 12 in the barrel to restrain the piston 6 when the barrel is moved forwardly.

As will now be described, the two barrel sections 2,4 are held in their assembled relationship by retainer elements in the form of pins 14 which are held by a retainer clip 16. The retainer pins 14 are mounted at the rear end of the front barrel section 4 and lie at the inner surface of the front barrel section 4. The pins 14 are in approximate diametrically-opposed relation but are not in exact diametrically-opposed relation for reasons which will become apparent; specifically, the two pins 14 are angularly displaced by a few degrees out of exact diametrically-opposed relation. Each of the two pins 14 engages in a separate axial guidance track defined by a groove 18 formed on the outer surface of the rear barrel section 2 and in the fully extended condition of the barrel each pin 14 is in engagement with the forward end edge 18*a* of its associated groove 18, the end edge 18*a* being of a rounded shape corresponding to that of the pin 14 so that a large area of contact exists between the pin 14 and the end edge 18*a* of the groove 18. In the contracted condition of the barrel, the pins 14 will lie a short distance forwardly of the rear end edges of the guidance grooves 18. On firing, the recoil will cause the rear barrel section 2 to move rearwardly so that the barrel approaches its extended condition. After the front end of the tool has been removed from the work surface the front barrel section 4 is moved forwardly by the operator and during this action the pins 14 engage the end edges 18*a* of the grooves 18 to draw the rear barrel section 2 forwardly so that the piston 6 is reset.

Entry of each pin 14 into its associated guidance groove 18 on assembly of the barrel and removal of the pin 14 upon disassembly of the barrel occurs via a transverse transfer track in the form of a groove 20 opening into the groove 18 at a position approximately midway along its length. One of the two transverse transfer grooves 20 opens into the axial slot 12 in the rear barrel section and the other transverse transfer groove 20 opens into an axial groove (not shown) formed on the external surface of the rear barrel section 2 opposite to the axial slot 12 and extending up to the forward end of the rear barrel section 2. Assembly of the two barrel sections is effected simply by inserting the rear barrel section 2 into the rear end of the front barrel section 4 with the two barrel sections angularly aligned so that the two retainer pins 14 will enter, respectively, the axial slot 12 and opposed axial groove in the rear barrel section 2, and the rear barrel section 2 is pushed forwardly until the transverse transfer grooves 20 reach the position of the two retainer pins 14 at which point the rear barrel section is rotated through approximately 90° whereby the retainer pins 14 enter the main axial guidance grooves 18 via the respective transfer grooves 20. Disassembly of the two barrel sections is effected by the reverse action. It will thus be appreciated that disassembly and subsequent reassembly of the two barrel sections as may be periodically required for cleaning purposes is effected by simple axial and rotational movement of one barrel section relative to the other and this occurs without the need to remove the retaining pins from the front barrel section. The angular displacement of the retainer pins 14 and, correspondingly, the axial slot 12 and opposed groove by a few degrees out of exact 180° relationship ensures that the front and rear barrel sections can only be fitted together in one specific angular relationship to ensure that the two barrel sections can only be fitted together in a manner in which the axial slots in the two barrel sections for the resetting pawl are in the same angular position.

Although the two retainer pins 14 are not required to be removable for the purposes of assembly and disassembly of the two barrel sections, each of the pins 14 acts as a shear pin which can break in the event of an overload situation which might occur if the tool is used with a relatively soft work piece whereby on firing the front barrel section 4 is driven forwardly. For this purpose the head of each retainer pin 14 is undercut at its rear end with a notch 14*a* by which the pin is engaged with an adjacent edge of the front barrel section. The notch 14*a* also defines a shear zone S at which the head of the pin 14 will shear if the front barrel section 4 is driven forwardly under high force on firing of the tool whereby the retainer pins 14 impact with high energy against the forward edges 18*a* of the axial guidance grooves 18. In this event the two retainer pins 14 are removable and replaceable by removal of the clip 16, insertion of new pins into keyhole-shaped apertures 22 in the front barrel section 4 and replacement of the clip 16 to retain the new pins 14 in position. However it is to be emphasised that shearing of the two pins is a safety function which occurs only in an overload situation and normal disassembly of the two barrel sections does not require removal of the pins.

The embodiment has been described by way of example only and modifications are possible within the scope of the invention.

We claim:

1. A power actuated tool comprising a barrel having a piston for driving a fastener into a substrate upon firing of an explosive charge, the barrel being mounted for axial movement within a body of the tool whereby to permit resetting of the piston to the rear of the barrel after firing by withdrawing the barrel forwardly of the body while the piston is restrained against forward movement, wherein the barrel comprises front and rear sections mounted for telescopic movement one relative to the other to an extent sufficient to accommodate recoil on firing of the tool, and at least one retainer element interposed between the front and rear barrel sections to cause entrainment of the rear barrel section with the front barrel section for forward movement therewith when the front barrel section is drawn forwardly of the body in order to reset the piston, the configuration being such that assembly and disassembly of the barrel sections can be accomplished by relative movement between the barrel sections without the need to remove the retainer element, said retainer element comprising a shear pin adapted to shear as a consequence of high energy impact in an overload situation, said pin being removably mounted so as to be replaceable when shearing occurs.

2. A tool according to claim 1 further comprising a removable clip for removably mounting the shear pin.

* * * * *

UNITED STATES PATENT AND TRADEMARK OFFICE

CERTIFICATE OF CORRECTION

PATENT NO. : 5,996,875

DATED : December 7, 1999

INVENTOR(S) : Clark, et al.

It is certified that error appears in the above-identified patent and that said Letters Patent is hereby corrected as shown below:

Col. 3, line 18, insert "two" after --The--.

Signed and Sealed this

Fifteenth Day of August, 2000

*Attest:*

*Attesting Officer*

Q. TODD DICKINSON

*Director of Patents and Trademarks*